United States Patent [19]

Love et al.

[11] Patent Number: 4,587,678

[45] Date of Patent: May 13, 1986

[54] TOILET SEAT BOOSTER

[76] Inventors: Larry W. Love, 2020 Cunningham Rd., Speedway, Ind. 46224; Raymond G. Gray, Sr., 9149 Tanglewood Dr., Indianapolis, Ind. 46227; Jerry A. Love, 510 Pioneer Dr., Indianapolis, Ind. 46217

[21] Appl. No.: 698,159

[22] Filed: Feb. 4, 1985

[51] Int. Cl.[4] ..... A47K 13/10; A47C 1/02

[52] U.S. Cl. ..... 4/251; 4/237; 4/254; 4/480; 297/330; 297/DIG. 10

[58] Field of Search ..... 4/254, 420, 237, 251, 4/661, 480, 478; 297/330, DIG. 10

[56] References Cited

U.S. PATENT DOCUMENTS

| | | | |
|---|---|---|---|
| 3,458,872 | 8/1969 | Hellstrom et al. | 4/237 |
| 3,473,174 | 10/1969 | Cool | 4/251 |
| 3,925,833 | 12/1975 | Hunter | 4/251 |
| 3,934,927 | 1/1976 | Zur | 297/330 |
| 4,083,599 | 4/1978 | Gaffney | 297/330 |
| 4,091,473 | 5/1978 | Matthews et al. | 4/420 |
| 4,168,552 | 9/1979 | Austin | 4/237 |
| 4,185,335 | 1/1980 | Alvis | 4/251 |
| 4,249,774 | 2/1981 | Andreasson | 297/330 |

FOREIGN PATENT DOCUMENTS

| | | | |
|---|---|---|---|
| 0077280 | 4/1983 | European Pat. Off. | 297/DIG. 10 |
| 2625046 | 12/1977 | Fed. Rep. of Germany | 297/DIG. 10 |
| 0632153 | 9/1982 | Switzerland | 297/DIG. 10 |
| 1150379 | 4/1969 | United Kingdom | 297/DIG. 10 |

*Primary Examiner*—Henry K. Artis

*Attorney, Agent, or Firm*—Barnes & Thornburg

[57] ABSTRACT

A boosting device is disclosed for a toilet seat. The boosting device includes a stationary frame having handrails. A seat frame assembly is pivotally coupled to the stationary frame by pivot pins. A single, ball screw motor and a lift arm are provided for pivotally moving the seat frame assembly relative to the stationary frame.

8 Claims, 5 Drawing Figures

TOILET SEAT BOOSTER

The present invention relates to toilet seat assemblies, and more particularly to boosting devices for toilet seats.

Several boosting devices for toilet seats are known. Cool U.S. Pat. No. 3,473,174 relates to a forward-tilting invalid toilet seat raising mechanism. The device includes a frame which is bolted to a conventional toilet bowl. The conventional toilet seat is attached with screws to a seat-supporting member. A reversible motor drives two hydraulic assemblies which are pivotally attached to the seat-supporting member and a base support.

Hellstrom et al. U.S. Pat. Nos. 3,458,872 and Alvis 4,185,335 disclose forward-tilting toilet seat raising mechanisms that operate on hydraulic power without a motor. Each of the devices described in these patents includes a toilet seat assembly to which a conventional toilet seat is attached.

Austin U.S. Pat. Nos. 4,168,552; Hunter 925,833; and Matthews 4,091,473 disclose toilet seat raising mechanisms that raise and lower a toilet seat bowl vertically. The Austin and Matthews devices utilize a threaded shaft to aid in this vertical movement. Austin's device includes a reversible motor having a protective covering, and a threaded rod which is connected between a jack assembly and the toilet seat.

Andreasson U.S. Pat. No. 4,249,774 relates to an invalid chair having a seat divided into a central saddle portion and a leg-supporting portion. The saddle portion of the chair is rigidly connected with the backrest of the chair. The leg-supporting portion is hingedly connected at the front end of the base of the chair. A linkage is provided so that when lifting the saddle portion, it will leave the leg-supporting portion and carry the person sitting on the saddle portion upwardly until the legs of the person are substantially straightened out, with the person's feet resting on the floor.

Zur U.S. Pat. Nos. 3,934,927 and Gafney 4,083,599 relate to a power tilting lounger and a rocking lift chair, respectively. Zur uses electric motors and drive shafts to move his tilting lounger.

Although all of the above-discussed devices relate to seating structures and many relate to toilet seat structures designed to aid the ill, the elderly, and the handicapped, all of the above devices have various problems.

One object of the present invention is to improve upon these known devices to provide a toilet seat boosting device which is economical to manufacture, safe to use, and well-suited to aid ill, elderly, and handicapped people in placing themselves upon a toilet seat and removing themselves from a toilet seat.

In accordance with the present invention, a boosting device is provided for a toilet seat. The boosting device comprises a stationary frame having handrails. A movable seat frame assembly is provided along with a pivot means for pivotally coupling the seat frame assembly to the stationary frame. Moving means are provided for pivotally moving the seat frame assembly relative to the stationary frame.

In a preferred embodiment, the moving means can comprise a single ball screw motor and a lift arm. The lift arm has a first end which is coupled to the seat frame assembly and a second end coupled to the screw motor. Additionally, a toilet seat can be provided which is supported by the seat frame assembly. The toilet seat is positioned relative to the seat frame assembly to include a portion disposed forward of the pivot means.

One aspect of the present invention is that a stationary frame is provided which includes stationary handrails. The position of the stationary handrails is unaffected by the movement of the seat frame assembly and toilet seat. The stationary handrails improve over some known devices which include handrails affixed to a movable seat frame member and move with the seat frame member.

The stationary handrails of the present invention provide more stable, better positioned handrails for the user to grip. Additionally, by not mounting the handrails to the movable seat frame assembly of the toilet seat booster, the stress imposed on the moving means can be reduced, as some of the weight exerted by the user on the seat is transferred through the handrails onto the stationary frame, and is thus removed from the movable seat frame assembly.

Further, the handrails are preferably positioned to extend forward of the seat frame assembly. Through this arrangement, the handrails are positioned to be in a better position for use by the user, especially during those times when the person is standing in front of the toilet seat.

One feature of the present invention is that the moving means which pivotally lifts the seat frame assembly comprises a single, ball screw motor. Some known devices utilize systems which employ twin moving systems, often in the form of two hydraulic cylinders. The single, ball screw motor of the present invention achieves several advantages over these twin systems. One advantage that can be achieved is a cost reduction from the use of a single system instead of a twin system.

The second advantage achieved is that the applicant's single motor can be safer than a twin system. For example, with twin motor or hydraulic cylinder systems, if one of the motors or cylinders ceases to function, the other motor or cylinder can continue to operate. This continued operation of only one of the two motors or cylinders can cause twisting of one side of the seat assembly relative to the other. In addition to possibly causing structural damage to the device, this twistinq movement can cause a user to lose his balance, thus causing the user to fall. This problem is especially acute with elderly, ill and handicapped persons who may not have the strength to prevent themselves from falling. With the present invention, if the motor should stop operating, the seat frame assembly will not move from the place wherein it was positioned at the time the motor stopped. This eliminates the possibility of the motor twisting the seat frame assembly.

Another feature of the present invention is that the device is configured to position the toilet seat on the movable seat frame assembly in a position wherein a small portion of the toilet seat extends forward of the axis about which the seat frame assembly pivots. Preferably, the front surface of the toilet seat is positioned to nest adjacent the nap of the user's knees. This feature has the advantage of being less likely to rub and chafe the user's legs during the lifting and lowering of the toilet seat. Additionally, the forward placement of the toilet seat provides the user with better ingress and egress to and from the seat by placing the seat in a more accessible position than some known prior art devices.

A further advantage achieved by the forward placement of the toilet seat is the reduction of stress on the moving means. By positioning a portion of the toilet seat forward of the pivot means, a portion of the user's weight is placed forward of the pivot means. This placement of a portion of the user's weight forward of the pivot means reduces the amount of weight lifted by the motor. This reduction of weight permits a single motor to be used for lifting the toilet seat, and obviates the need for a twin motor system.

Additional features and advantages of the invention will become apparent to those skilled in the art upon consideration of the following detailed description of a preferred embodiment exemplifying the best mode of carrying out the invention as presently perceived. The detailed description particularly refers to the accompanying drawings in which.

Figure 1:
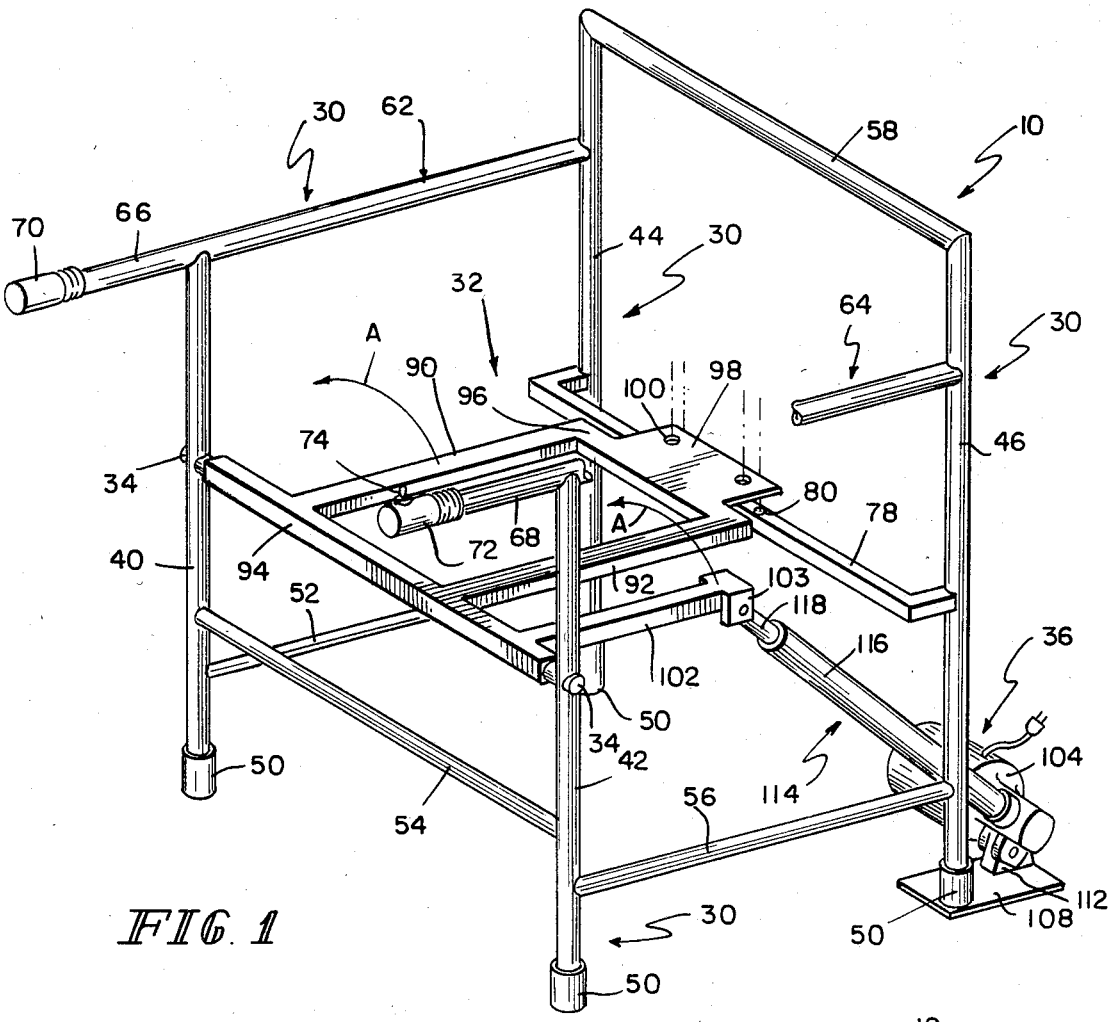
FIG. 1 is a partial, perspective view, partly broken away, of the present invention.

A boosting device 10 for a toilet seat 12 is shown in the figures. The boosting device 10 is shown as being used in conjunction with a toilet 16 having a toilet bowl 18 with an upper peripheral rim 20, and a toilet tank 22 having a tank lid 24. It should be understood, however, that the boosting device 10 of the present invention is adaptable for use with toilets having configurations other than that shown in the figures.

The boosting device 10 includes a stationary frame 30 which is stationarily positioned relative to the ground and toilet 16. A seat frame assembly 32 is pivotally coupled to the stationary frame 30 by a pivot means such as a pair of pivot Pins 34. The toilet seat 12 is coupled to the seat frame assembly 32, and is supported on the upper surface of the seat frame assembly 32. A moving means 36 is provided for pivotally moving the seat frame assembly 32 relative to the stationary frame 30.

The moving means 36 moves the seat frame assembly 32, and hence the toilet seat 12 supported on the seat frame assembly 32, about a pivot axis defined by the pivot pins 34, in a direction indicated generally by arrow A in FIG. 1. The seat frame assembly 32 moves between a rest position (shown in FIG. 2) wherein the seat frame assembly 32 is generally parallel to the ground and the upper peripheral rim 20 of the toilet bowl 18, and a raised position (shown in FIG. 3) wherein the seat frame assembly 32 and toilet seat 12 are angled upwardly to be tilted forward.

The components of the stationary frame 30 are preferably made of a tubular stainless steel and include first and second upright front frame members 40, 42. The first and second upright front frame members 40, 42 are positioned generally in front of the toilet bowl 18, and are spaced from each other by a sufficient distance to place the first and second front frame members 40, 42 on opposite sides of the toilet bowl 18. Additionally, the front frame members 40, 42 are sufficiently tall so that their top ends are positioned above the toilet seat 12. For example, in one embodiment of the invention, the first and second front frame members 40, 42 are each approximately 28½inches (72 cm) tall, extend 9 inches (23 cm) above the toilet seat 12 when the toilet seat 12 is in its rest position, and are spaced apart by approximately 21 inches (53 cm).

The stationary frame 30 also includes first and second upright rear frame members 44, 46. The first and second rear frame members 44, 46 are generally similar to the front frame members 40, 42 except that in the preferred embodiment, the rear frame members 44, 46 are slightly taller than the front frame members 40, 42, so that the tops of the rear frame members 44, 46 are positioned above the upper surface of the tank lid 24. The rear frame members 44, 46 are preferably spaced apart from each other by the same distance that the front frame members 40, 42 are spaced apart from each other. For example, in one embodiment, the rear frame members 44, 46 are 33 inches (84 cm) tall, to be positioned 4½inches (11 cm) above the upper surface of the tank lid 24, are separated from each other by a distance of 21 inches (53 cm), and are each spaced from their corresponding front frame members 40, 42 by a distance of 15 inches (38 cm).

Each of the front and rear frame members 40, 42, and 44, 46 is provided with a threaded lower end for receiving a threaded foot sleeve 50. The threaded foot sleeves 50 threadedly engage the threaded lower ends of the frame members 40, 42, 44, 46 to permit the user to level the boosting device 10, to stabilize it on a bathroom floor.

Additionally, in a preferred embodiment, the front and rear frame members 40, 42 and 44, 46 can be telescoping frame members. The use of telescoping frame members permits the user to adjust the height of the device to suit his particular needs, or to be compatible with the size of his toilet 16.

First, second, third, and fourth brace members 52, 54, 56, 58 extend between various pairs of the frame members 40, 42, 44, 46. The brace members 52, 54, 56, 58 link pairs of the frame members 40, 42, 44, 46 together to provide structural rigidity and strength to the boosting device 10. The fourth brace member 58 is positioned to be spaced sufficiently from the tank lid 24, not to restrict the user from removing the tank lid 24 from the toilet tank 22.

The stationary frame 30 also includes first and second stationary, horizontally extending handrails 62, 64. The handrails 62, 64 are generally parallel and extend between their respective rear frame members 44, 46 and front frame members 40, 42. The handrails 62, 64 each include portions 66, 68 disposed forward of the front frame members 40, 42. These forwardly disposed portions 66, 68 are placed forward of the toilet bowl 18 and front frame members 40, 42, to be positioned for the user to grip them 66, 68, conveniently. This convenient placement is especially helpful when the user is positioning himself to sit on the toilet seat 12 and when the user is removing himself from the toilet seat 12 and positioning himself to return to a wheelchair, or begin walking with the aid of a cane or walker. The forward placement of the portions 66, 68 of the handrails 62, 64 enables the user to grip the handrails 62, 64 with his hands and arms at his side, and does not force the user to place his hands and arms behind him to grip the handrails 62, 64.

Rubber handgrips 70, 72 are placed at the forward ends of the forward portions 66, 68 to provide a better gripping surface for the user. A switch 74 can be disposed adjacent one or both of the handgrips 70, 72 for actuating the moving means 36.

The stationary frame 30 further includes a C-shaped cross brace member 78 which extends between the first and second rear frame members 44, 46. The C-shaped cross brace member 78 includes a pair of spaced apertures 80 which are alignable with apertures (not shown) in the upper peripheral rim 20 of the toilet bowl 18. A pair of bolts 84 pass through the aligned apertures 80, (not shown) for securely coupling the stationary frame 30 to the toilet 16.

The seat frame assembly 32 includes first and second seat frame members 90, 92. The first and second seat frame members 90, 92 are generally parallel. Each of the seat frame members 90, 92 are coupled at their forward ends to a transverse seat frame member 94. Transverse seat frame member 94 extends generally between the first and second front frame members 40, 42, and is pivotally coupled to each of the first and second front frame members 40, 42 by pivot pins 34. A seat frame cross brace member 96 is coupled to and extends between the rearward ends of the first and second seat frame members 90, 92. The seat frame cross brace member 96 includes a horizontally disposed, rearwardly extending flange 98. Flange 98 includes a pair of spaced apertures 100 which are alignable with apertures (not shown) in the toilet seat 12 for mounting the toilet seat 12 onto the seat frame assembly 32. The flange 98 is positioned to rest on the C-shaped cross brace member 78 of the stationary frame 30, when the seat frame assembly 32 is in its rest position.

The seat frame assembly 32 also includes a lever arm 102 which is connected at one end to the transverse seat frame member 94 and extends generally parallel to the first and second seat frame members 90, 92. The lever arm 102 includes a swivel bracket 103 at its rearward end for swivelably coupling the moving means 36 to the seat frame assembly 32.

The lever arm 102 is preferably about 12 inches (30 cm) long, to extend approximately two-thirds of the way from the transverse frame member 94 to the C-shaped cross brace member 78. The relatively long length of the lever arm 102 permits the moving means 36 to gain a substantial mechanical advantage in its movement of the seat frame assembly 32.

The moving means 36 includes a single, ball screw motor 104 which illustratively can be a ball drive actuator manufactured by Motion Systems Corporation of Shrewsbury, NJ. The screw motor 104 is swivelably mounted to a mounting means such as a mounting plate 108. Mounting plate 108 includes a swivel bracket 112 to which the screw motor 104 is swivelably mounted. Mounting plate 108 also includes an upwardly opening threaded foot sleeve 50, which is fixed to the mounting plate 108. The mounting plate's 108 threaded foot sleeve 50 receives the lower portion of the second upright rear frame member 46 for securing the mounting plate 108 to the stationary frame 30, and for properly positioning the mounting plate 108, and hence screw motor 104, relative to the stationary frame 30.

The moving means also includes a lift arm 114 which is coupled between the lever arm 102 and the screw motor 104. Lift arm 114 includes a non-rotating, outer sleeve 116 having a first end 118 which is swivelably mounted to the swivel bracket 103 at the rearward end of lever arm 102. The outer sleeve 116 includes a threaded interior surface (not shown) for receiving a rod 122 having a threaded exterior surface. The screw motor 104 is coupled to the threaded rod 122 for rotating the threaded rod 122 relative to outer sleeve 116. As shown best in FIGS. 2 and 3, the rotation of the threaded rod 122 relative to the non-rotating outer sleeve 116 changes the effective length of the lift arm 114, to permit the lift arm 114 to move the seat frame assembly 32, and hence toilet seat 12 between its rest position (shown in FIG. 2) and its raised position (shown in FIG. 3).

Figure 4:
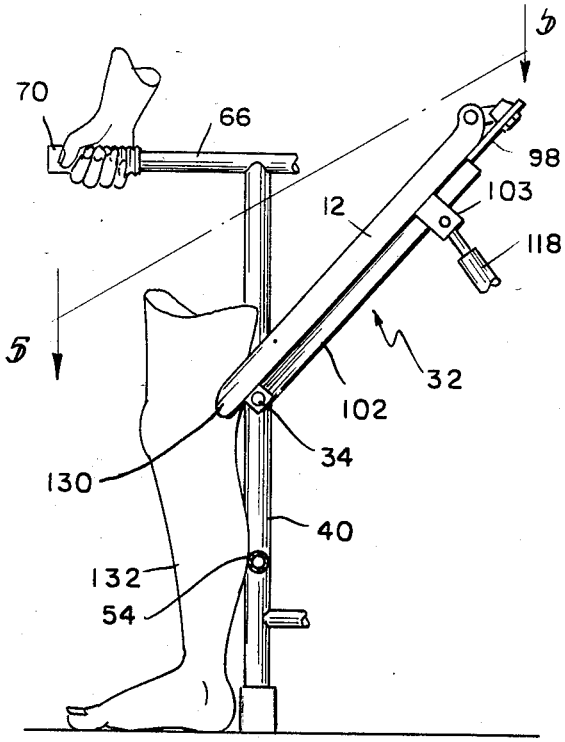
FIG. 4 is a side view of a portion of the device showing the relationship of the device to a user.
Figure 5:
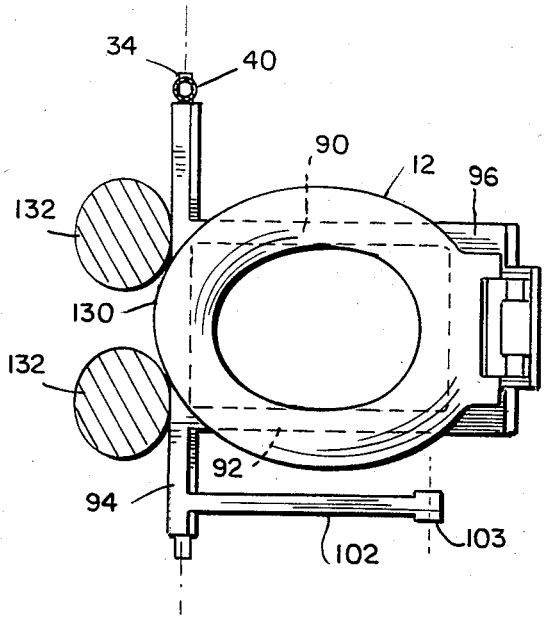
FIG. 5 is a sectional view taken along lines 5—5 of FIG. 4.

As best shown in FIGS. 4 and 5, the toilet seat 12 is supported by the seat frame assembly 32 and is positioned relative to seat frame assembly 32 to include a forward portion 130 which is disposed forward of the transverse frame member 94 and the pivot pins 34. This forward portion 130 is positioned to nest adjacent the nap of the knees of the legs 132 of the user. When so positioned, the raising and lowering movements of the toilet seat 12 tend to not chafe or otherwise rub against the rear surfaces of the user's legs 132.

The placement of the forward position 130 of the toilet seat 12 in front of the transverse seat frame member 94 and pivot pins 34 causes a portion of the user's weight to be placed forward of the pivot pins 34, and reduces the amount of the user's weights placed behind the pivot pins 34. This placement of a portion of the user's weight forward of the pivot pins 34 reduces the amount of weight lifted by the motor 104. This reduction of weight permits a single motor 104 to lift the toilet seat 12, and obviates the need for a twin motor system.

Figure 2:
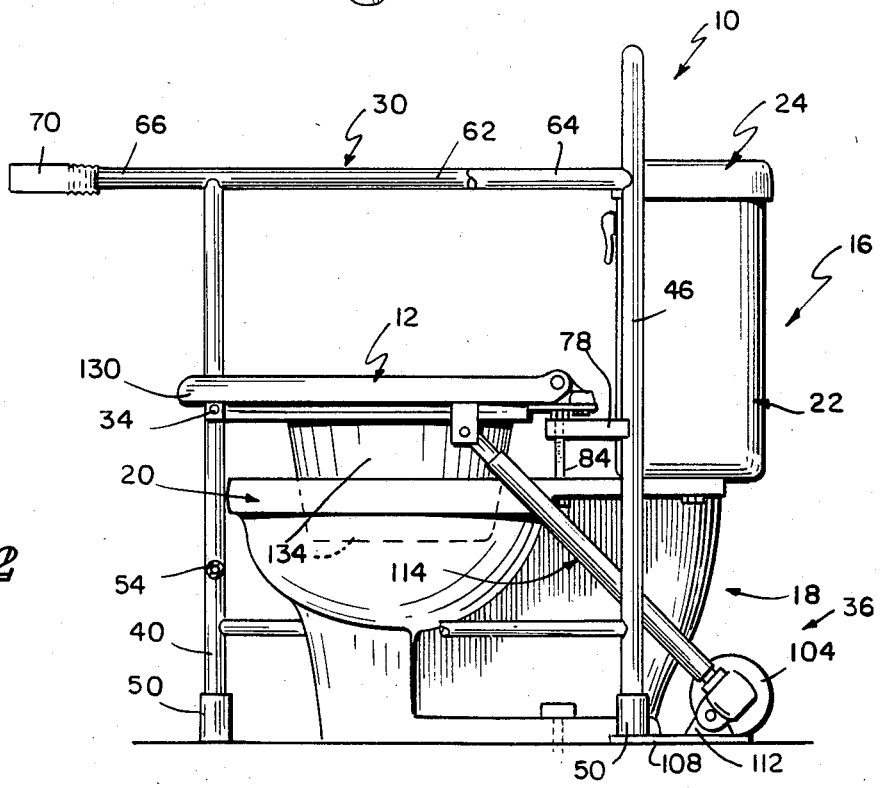
FIG. 2 is a side elevational view of the present invention showing the toilet seat in its rest position.
Figure 3:
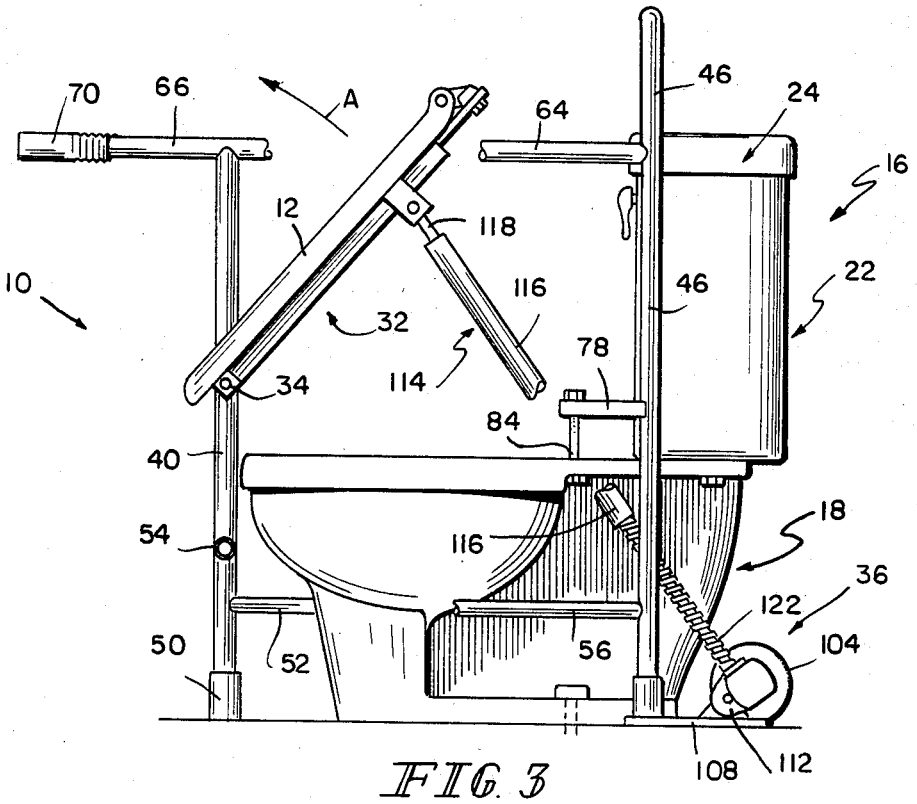
FIG. 3 is a side elevational view, partially broken away, of the present invention showing the toilet seat in its raised position.

As shown in FIG. 2, a frustoconical splash shield 134 having open, lower and upper ends can include a peripheral rim (not shown) adjacent the upper end of the splash shield 134 which is positioned to rest on the upper surfaces of the first and second seat frame members 90, 92. The splash shield 134 is provided for directing waste material into the interior of the toilet bowl 18 and preventing the waste material from being deposited inadvertently on the floor adjacent the toilet 18.

Although the invention has been described in detail with reference to certain preferred embodiments and specific examples, variations and modifications exist within the scope and spirit of the invention as described and as defined in the following claims.

What is claimed is:

1. A boosting device for a toilet seat comprising a stationary frame includng first and second upright front frame members, first and second upright rear frame members, a first handrail extending between the first front and first rear upright frame members, and a second handrail extending between the second front and second rear upright frame members, each of the first and second handrails including a portion disposed forward of the respective first and second front upright frame members, a movable seat frame assembly, pivot means for pivotally coupling the seat frame assembly to the stationary frame, and moving means for pivotally moving the seat frame assembly relative to the statinary frame, the movable seat frame assembly including a seat frame for supporting a toilet seat and a transverse seat frame member extending between the first and second front upright frame members and coupled to the first and second front upright frame members by said pivot means.

2. The invention of claim 1 further comprising a lever arm having a first end coupled to said transverse seat frame member and a second end coupled to said moving means.

3. The invention of claim 2 wherein the moving means comprises a single, ball screw motor and a left arm having a first end coupled to said lever arm and a second end coupled to the screw motor.

4. The invention of claim 3 further comprising a motor mounting means, and swivel means for swivelably mounting the screw motor to the motor-mounting means.

5. The invention of claim 1 wherein said stationary frame includes a cross brace member extending between said first and second upright rear frame members, further comprising connecting means for connecting said rear cross brace member to a toilet.

6. The invention of claim 1 wherein said seat frame comprises first and second, spaced seat frame members having upper surfaces and a seat frame cross brace member extending between the first and second spaced seat frame members, further comprising means for attaching a toilet seat to the seat frame cross brace member to position the toilet seat adjacent the upper surfaces of the seat frame members.

7. The invention of claim 6 wherein said stationary frame includes a cross brace member extending between said first and second upright rear frame members, the seat frame cross brace member being restable on said cross brace member of the stationary frame.

8. The invention of claim 6 wherein said toilet seat, when attached to the seat frame cross brace member, is positioned on the seat frame so that a portion of the toilet seat extends forward of said transverse seat frame member.

* * * * *